US010701493B2

(12) United States Patent
Naumann et al.

(10) Patent No.: US 10,701,493 B2
(45) Date of Patent: Jun. 30, 2020

(54) METHOD OF OPERATING A HEARING AID, AND HEARING AID

(71) Applicant: SIVANTOS PTE. LTD., Singapore (SG)

(72) Inventors: Frank Naumann, Bubenreuth (DE); Benedikt Heuer, Nuremberg (DE)

(73) Assignee: Sivantos Pte. Ltd., Singapore (SG)

( * ) Notice: Subject to any disclaimer, the term of this patent is extended or adjusted under 35 U.S.C. 154(b) by 75 days.

(21) Appl. No.: 15/872,155

(22) Filed: Jan. 16, 2018

(65) Prior Publication Data

US 2018/0206047 A1 Jul. 19, 2018

(30) Foreign Application Priority Data

Jan. 16, 2017 (DE) ..... 10 2017 200 599

(51) Int. Cl.
*H04R 25/00* (2006.01)

(52) U.S. Cl.
CPC ..... *H04R 25/505* (2013.01); *H04R 25/50* (2013.01); *H04R 25/554* (2013.01); *H04R 2225/41* (2013.01); *H04R 2225/55* (2013.01); *H04R 2460/07* (2013.01)

(58) Field of Classification Search
CPC ..... H04R 2225/41; H04R 2225/55; H04R 2460/07; H04R 25/50; H04R 25/505; H04R 25/554; H04R 25/43
USPC ..... 381/317, 314, 60
See application file for complete search history.

(56) References Cited

U.S. PATENT DOCUMENTS

| | | | | |
|---|---|---|---|---|
| 8,457,335 | B2 | 6/2013 | Imamura et al. | |
| 9,648,430 | B2 * | 5/2017 | Dittberner | H04R 25/70 |
| 9,668,069 | B2 * | 5/2017 | Han | H04R 25/43 |
| 10,219,083 | B2 * | 2/2019 | Farmani | H04R 1/1083 |
| 2010/0189293 | A1 * | 7/2010 | Imamura | H04R 25/558 381/317 |
| 2015/0003652 | A1 | 1/2015 | Bisgaard et al. | |
| 2015/0124984 | A1 * | 5/2015 | Han | H04R 25/43 381/60 |
| 2015/0172831 | A1 | 6/2015 | Dittberner et al. | |
| 2015/0326983 | A1 | 11/2015 | Johnson et al. | |
| 2016/0234606 | A1 | 8/2016 | Selig et al. | |
| 2018/0206047 | A1 * | 7/2018 | Naumann | H04R 25/505 |
| 2018/0262849 | A1 * | 9/2018 | Farmani | H04R 1/1083 |

FOREIGN PATENT DOCUMENTS

| | | | |
|---|---|---|---|
| EP | 2164282 | A1 | 3/2010 |
| EP | 2884766 | A1 | 6/2015 |

* cited by examiner

*Primary Examiner* — Phylesha Dabney
(74) *Attorney, Agent, or Firm* — Laurence A. Greenberg; Werner H. Stemer; Ralph E. Locher

(57) ABSTRACT

A method for the operation of a hearing aid is disclosed. The hearing aid can be worn by a user and contains a number of programs each of which is as-signed to a respective noise situation. A current noise situation is recognized both depending on the location and depending on time. Whichever program is assigned to the current noise situation is selected and set. A corresponding hearing aid is also disclosed.

16 Claims, 2 Drawing Sheets

METHOD OF OPERATING A HEARING AID, AND HEARING AID

CROSS-REFERENCE TO RELATED APPLICATION

This application claims the benefit, under 35 U.S.C. § 119, of German patent application DE 10 2017 200 599.8, filed Jan. 16, 2017; the prior application is herewith incorporated by reference in its entirety.

BACKGROUND OF THE INVENTION

Field of the Invention

The invention relates to a method for operating a hearing aid and to such a hearing aid.

Hearing aids is generally used to service users with damaged or impaired hearing, in order to permit improved hearing. The user of a hearing aid usually wears it in or on the ear. The hearing aid picks up noises, i.e. all kinds of sound or sound signals, from the environment, amplifies them, and outputs them as reinforced or amplified audio signals to the user. A processing, for example filtering, frequently also takes place in addition to or as an alternative to the amplification. The hearing aid thus generally incorporates a number of operating parameters which are usually individually adjusted for the user in order appropriately to modify a sound that has been picked up.

Different soundscapes are often found at various locations, for which reason it is helpful to change the operating parameters depending on the current noise situation.

A hearing aid is, for example, described in patent application No. US 2015/0003652 A1, which automatically recognizes a sound situation and adjusts the operating parameters depending on the recognized sound situation. The geographical position of the user, i.e. the location at which the user is found, is included here in the recognition of the sound situation. The fact that the noise situation remains the same at a specific location over a relatively long time is exploited here. A GPS system is, for example, used to determine the location. If the location cannot be determined directly in this manner, other information is alternatively evaluated, for example a calendar of the user, from which the place where the user presumably is can be taken.

SUMMARY OF THE INVENTION

It is an object of the invention to provide a hearing aid and an operating method which overcome a variety of disadvantages of the heretofore-known devices and methods of this general type.

With the foregoing object in view there is provided, in accordance with the invention, a method of operating a hearing aid to be worn by a user, the hearing aid having a plurality of programs respectively assigned to a noise situation. The method comprises the following steps:

recognizing a current noise situation depending on a current location and time; and selecting and setting whichever program is assigned to the current noise situation.

The method serves for the operation of a hearing aid, and is preferably also used for this purpose. The hearing aid can be worn by a user. The method is in particular carried out when the hearing aid is also worn by the user. The user is usually a person with impaired hearing capacity. The hearing aid comprises a number of programs, each of which is assigned to a noise situation or a noise environment. The programs here are, in particular, each a group of particular settings for a number of operating parameters of the hearing aid. An operating parameter is, for example, the amplification. The hearing aid has at least one microphone for picking up noises, and an earpiece for the output of modified noises. "Noise" refers in general to "sound" or "sound signal." The hearing aid also comprises a control unit that sets the programs. The hearing aid usually comprises one or two hearing aid units, and in more recent variants is, in particular, a binaural hearing aid.

The hearing aid can be switched between different programs in order to ensure an optimum setting of the operating parameters of the hearing aid in different situations. A respective noise situation is characterized by a number of situational parameters, usually at least one volume level. Each program is appropriate for at least one particular noise situation, so that an optimum compensation of the user's hearing impairment can be ensured in the respective noise situation. The program comprises particular specifications for the operating parameters for this purpose, so that when a suitable program is activated, i.e. set, the operating parameters are appropriately set.

In the method, a current noise situation is recognized both depending on the location and depending on time, and whichever program is assigned to the current noise situation is selected and set. In other words, the noise situation is determined through determining both the location and the time, which represent two parameters, on whose basis the noise situation that is present is recognized. That is to say that a location determination and a time determination are carried out, and a specific noise situation is assumed on the basis of the result. The optimum program for this noise situation is then selected and set. The selection and, in particular, also the setting, preferably occur automatically. The location is, for example, a restaurant, an apartment, a street or a workplace. The time is, for example, the time of day, for example characterized by the current hour or, in addition, also by the current minute, the current day of the week, the current month or a date, for example characterized by the day and month or, additionally, also by the current year.

One advantage of the invention is in particular that the optimum program at a specific location can be selected and set immediately, without sometimes having to first carry out a time-consuming analysis. It is, in principle, conceivable that a noise situation is recognized through analysis of the existing noises, i.e. sound signals. Such an analysis, however, first necessitates the recording of noises, followed by a processing. This is, accordingly, time-consuming. Here, in contrast, the location and time are determined in order to deduce the current noise situation. When recognizing the noise situation, a recording of noises or of environmental noises is, in particular, omitted, i.e. the noise situation is determined exclusively on the basis of location and time. In other words, a location and a time are determined, and the noise situation is exclusively recognized on the basis of the location and the time. Preferably a classification of environmental noises is omitted, in particular when determining location and time. In one variant, on the other hand, an additional classification of, in particular, environmental noises is performed, in order to determine the location, the time, or both, more reliably.

A further advantage is, in particular, that the selection and setting is performed not merely depending on the location, but also depending on time. This is because it is recognized here that the noise situation at a particular location does not necessarily remain constant, and a purely location-dependent setting of the hearing aid would not always be expedient, but rather that the noise situation at one location often also changes over time. A restaurant, for example, has different numbers of customers at different times of day, so that the volume level at this location varies depending on time. Similar considerations apply to a street which at different times carries different amounts of traffic, and the noise volume therefore differs. A program which, for example, at midday takes a high noise level into account is then unsuitable in the afternoon, for example, when it is quieter. The additional time-dependency of the noise situation at the same location thus in general under some conditions leads to unfavorable settings. In the present case this is avoided through the additional time-dependent recognition of the noise situation.

The location-dependent selection of the program is thus advantageously improved through an additional time-dependent selection at a particular location. The program is thus selected, so to speak, in two steps. A location is here first determined, in particular the location of the user. A time is then determined, in particular the current time, and then one of a plurality of programs for the location is selected depending on the time, and the selection is thereby refined for precisely this location. It is assumed here that different programs are more suitable for a given location at different times. The program is thus altogether selected with reference to two parameters, namely time and location, and not merely on the basis of one parameter. The method described here thereby differs even from such methods in which firstly, on the basis of one parameter, for example a location, a program is selected, and then an adaptation to a possibly changed noise situation is then performed in a dynamic manner during operation and over time. In the present case, rather, a program is directly selected on the basis of two parameters, i.e. an initial selection is made which is more precise from the very beginning, since both the location and the time are taken into account here.

The current noise situation is preferably recognized depending on the location, in that the location at which the user is currently found is determined, preferably by means of a GPS system. In this way, precisely the particular noise situation that is relevant for the user in the light of the location is recognized. A location sensor is used for this, preferably a GPS system. This is, for example, integrated into the hearing aid. The location sensor is, alternatively, integrated into an external de-vice, appropriately a smart phone, which the user is expediently also carrying with him. The external device is then connected, for example wirelessly, to the hearing aid, in order to convey the location, i.e. the location information. Alternatively or in addition, a transmitter is erected at the location, which conveys the current location.

In a particularly preferred embodiment, the current noise situation is determined depending on location and time by means of a characteristic noise map. The characteristic noise map is also referred to as a characteristic parameter map or as a sound map. The characteristic noise map thus in general contains the noise situation at a specific location and time, and is thus, in particular, a data record or a catalog. "Function" here also refers to a tabular assignment. The noise situation itself does not here have to be stored directly in the characteristic noise map; what is important rather is that the characteristic noise map for a given location and for a given time contains information for determination of the noise situation, i.e. a parameter which is related to the noise situation. The parameter is also referred to as the situation parameter which allows the associated noise situation to be determined on the basis of the concrete value of the parameter. Alternatively or in addition, the noise situation is itself contained depending on location and on time as information in the characteristic noise map. Through the characteristic noise map, the noise situation at the corresponding location is directly or indirectly stored at different times, in particular at each time, and is thus known in advance. With the knowledge of the current time, the noise situation can then be determined from the characteristic noise map. Previously accumulated experience is preferably evaluated for this purpose, i.e. the knowledge of what noise situation is present at what time and at what location. This knowledge then permits an immediate, optimum program selection, in particular even when the user has never previously entered a particular location at a particular time.

In a particularly preferred embodiment, the location is determined by coordinates, so that the program is selected depending on the location with reference to the concrete location of the user. The location is here, in particular, characterized by two coordinates, preferably the geographical longitude and latitude. In one variant, the location is also additionally characterized by a height, and thus by a total of three coordinates. The coordinates are preferably GPS coordinates or similar data.

Alternatively or in addition, the location is a location type, so that the program is then selected depending on the type or the nature of the location. The concrete coordinates are not necessarily crucial here. More important, rather, is that similar locations are also recognized as similar, i.e. as the same type of location, and accordingly the same program is selected for such similar locations. Examples of such location types are a road, a small room, a church, a theatre, the interior of the vehicle, a workplace, an open space etc. Different types of location differ from one another in at least one situation parameter, and are, to that extent, separable from one another. In an appropriate embodiment, the noise situation is then deter-mined, depending on the location, in that at least one location type classification is first carried out, in which a current location type is determined, i.e. in which the current location type is classified. The noise situation is then determined, depending on time, in a characteristic noise map for the current location type.

The situation parameter is, appropriately, a piece of map information, a reverberation time, an interfering noise, a frequency spectrum or a magnitude derived from these. Other situation parameters are also conceivable and suitable. In the case of the map information, the location type is determined through a map on which special locations, such as tourist attractions, roads etc. are already identified. The location type is then determined with reference to the map in combination with the site where the user is. In the case of the reverberation time, the location type is determined with reference to the reverberation time of the location; this is either measured or is specified, e.g. by an on-site information system. In particular in public places or in public buildings, the local reverberation type is regularly made available by an information system with which the hearing aid can be connected, in particular via a wireless connection. Locations can also be distinguished through interfering noises, e.g. by an interfering noise level, i.e. the volume of interfering noises at the site, or by an interfering noise frequency. The location is then generally determined, in that a determination is made as to what type of interfering noise is present. Similar considerations apply to the determine the location with reference to a frequency spectrum.

In a particularly preferred embodiment, a plurality of characteristic noise maps of the plurality of locations together form a characteristic map matrix, i.e. a data set of characteristic noise maps. The characteristic map matrix is preferably multi-dimensional. The noise situation is here parameterized by the two parameters of time and location. As described above, the location is preferably two-dimensional or, in another variant that is also suitable, three-dimensional. The time is preferably one-dimensional, but in another variant that is also suitable, multi-dimensional. Altogether the characteristic map matrix is thus accordingly three-dimensional or four-dimensional, wherein the dimensions of the noise situation is not included. The noise situation is thus stored in a multi-dimensional characteristic map matrix, and is parameterized by time and location. A comprehensive database results from this, from which the appropriate program at a particular location and at a particular time can be selected for the hearing aid with high precision.

The determination of the location on the basis of the current location of the user is not necessarily unambiguously possible. When the location is determined by means of GPS, for example, it is difficult to distinguish between locations positioned on top of one another. "Locations positioned on top of one another" here refers to a plurality of locations which, although having the same or similar coordinates, in particular in two dimensions, nevertheless are arranged at different heights. Different noise situations can, however, be present at such locations, and require different programs for the hearing aid. A building, for example a church, which is for example located above an underground railway station, or rooms with different functions are arranged on different floors of a multi-storey building, for example a bedroom and a working room. In an expedient embodiment, the current noise situation is then recognized, depending on the location, in that a location of the user is determined in a two-dimensional space in particular by means of GPS, and in that, in addition, an auxiliary magnitude is used by means of which different locations at the same site are distinguished. The auxiliary magnitude is also referred to as an auxiliary parameter. The location recognition is thus advantageously supported through the use of the auxiliary magnitude. This is used, above all, for the more precise determination of the location, which potentially cannot unambiguously be determined.

The auxiliary magnitude is preferably a parameter, as described above in connection with the determination of the location type; thus for example a piece of map information, a reverberation time, an interfering noise, a frequency spectrum or a magnitude derived from these. The auxiliary magnitude is, in particular, deter-mined in operation and, in particular, when required. The auxiliary magnitude provides additional information which advantageously permits reaching a decision in the event of location information that is inadequate or ambiguous. Reaching a decision in this way is appropriately also preferably performed when a plurality of locations or location types come into question.

A development in which a location is assigned to the characteristic noise map and in which precisely this characteristic noise map is used for recognition of the noise situation is particularly suitable if the user is at the particular location which is assigned to the characteristic noise map. In other words, a suitable characteristic noise map is stored for each location, and is then used when the user enters the corresponding location. In the method, the location is first determined, and thereupon the appropriate characteristic noise map is selected depending on the location. In addition, the time is determined and then the noise situation in the selected characteristic noise map which is assigned to the determined time, i.e. which has been saved for the determined time, is determined.

Preferably the characteristic noise map is made available by an external device. The characteristic noise map, in other words, is stored outside the hearing aid and in an external device. The external device is preferably a server or a smart phone. An external device has, in particular, the advantage that it has significantly more storage space than the hearing aid and, in addition, has a higher computing capacity and also a more extensive energy supply. In this way the hearing aid is relieved of load in the sense of storage space and energy consumption. In a first variant, the external device serves only as storage for one or more characteristic noise maps, and then transmits this/these to the hearing aid. The transmission takes place, in particular, when required, for example when entering the location whose characteristic noise map is thereupon transferred. A restaurant, for example, holds a characteristic noise map ready on its own server, and transmits this to users as soon as they enter the restaurant. A cloud solution with a centralized server which then keeps characteristic noise maps for a plurality of locations saved, is also suitable. Multiple users in particular can then, when required, request the respectively required characteristic noise map from the server. For this purpose, the hearing aid is, for example, connected to the server immediately via the Internet, or indirectly, e.g. via a smart phone. In this way it is, in addition, also advantageously possible for the user, through reference in advance to the characteristic noise maps, to determine such locations as are particularly quiet or which meet other, user-specific requirements.

An external device that is connected for data exchange to the hearing aid is appropriately used to determine the location, to determine the time, to recognize the current noise situation or for a combination of these. The external device is, in particular, the above-described external device. To determine the noise situation on the basis of a characteristic noise map that is stored, saved or made available on an external device, it is appropriate either for the characteristic noise map to be conveyed to the hearing aid, or for the time and location to be conveyed to the external device and for this then to determine the current noise situation and convey this to the hearing aid. As described above, the external device is, in particular, a smart phone, particularly for determining the location. Alternatively or in addition, the external device is a server. Such a device is particularly suitable for determining the time and for recognizing the noise situation.

The characteristic noise map is, in particular, determined in advance, for example by the user, in that said user regularly determines the noise situation with his hearing aid, particularly using a noise analysis as explained above, and that this noise situation is then provided with a location stamp and a timestamp, and is saved. This is expediently performed automatically by the hearing aid. A plurality of such measurements are then combined into a characteristic noise map, and are available for a later call-up.

In general, the noise situation is stored in the characteristic noise map. In general the noise situation is stored in the form of a situation parameter dependent on location and time. Put more precisely, multiple values of the situation parameter at different locations and at different times, i.e. depending on location and time, are saved in the characteristic noise map. In particular, precisely one value is saved for a given location and a given time. The characteristic noise map thus contains a specific parameter that is relevant to the selection of the optimum program. The noise situation is then determined in that the location and time are first determined, after which the situation parameter is consulted in the characteristic noise map depending on the location and time, and then, on the basis of the situation parameter, the noise situation is determined. Accordingly, the noise situation is then also parameterized depending on location and time.

In one suitable embodiment, the situation parameter is a noise situation or a pro-gram for the hearing aid, i.e. the location-dependent and time-dependent noise situation, or the program appropriate, for this is stored directly in the characteristic noise map. This embodiment is not, however, essential; rather, even a single parameter is often sufficient to characterize the noise situation. In one suitable variant, the situation parameter is therefore a concrete property of noise situations in general and of noises or locations in particular. Such properties are, in particular, the volume, i.e. the level, frequency spectrum, transience i.e. duration, reverberation time, noise power and the like. The noise situation is then determined on the basis of the situation parameter, and the appropriate program is selected.

In one suitable embodiment, a volume level as a function of time is stored as the situation parameter in the characteristic noise map. The volume level, or the volume in short, is thus saved depending on location and time in the characteristic noise map. The characteristic noise map thus indicates the time-dependent volume level at a particular location. The location-dependent and time-dependent determination of the noise situation then corresponds to a determination of the volume at a given location at a given time over a data set, particularly one known in advance, namely the characteristic noise map. A local measurement of the volume is not necessary, and such a volume measurement for selection of the pro-gram is therefore preferably omitted. Depending on the volume level recognized, i.e. determined from the characteristic noise map, a suitable program for the hearing aid is then selected and set.

Preferably the situation parameter is stored, two-dimensionally in terms of time of a function of the time of day and of the day of the week. The characteristic noise map then forms a map, with two time axes and with the situation parameter on a third axis. Altogether, a height profile results, in which, in an advantageous man-ner, the user can distinguish quiet periods from loud periods even in a purely visual manner. The two-dimensional configuration recognizes in particular the consideration that even a recognition of the noise situation that depends on the time of day can yet be erroneous. The recognition of the noise situation is then significantly improved through a separate consideration of the time of day and the day of the week. For example, the fact that different noise situations are present at certain locations at weekends compared to working days is advantageously taken into account.

It is appropriate for the hearing aid to measure a situation parameter, whereby a measured value is generated, and this measured value is given a location stamp and a timestamp and is stored in particular in the characteristic noise map. Char-acteristic noise maps for later use are generated in this way. As explained above, the situation parameter is preferably the volume level. This is measured, in particular, with a microphone. The microphone is expediently a microphone of the hearing aid, so that the characteristic noise map is thus populated by data directly by means of the hearing aid. The user thus contributes, in particular continuously, to improvement of the characteristic noise map at those locations which he most regularly visits. The timestamp and the location stamp are each also here generated by the hearing aid or by an external device, or by both.

It is particularly expedient to employ other sources for the measurement and for populating the characteristic noise map, alternatively or in addition to the hearing aid. In one appropriate embodiment, the characteristic noise map is composed of a plurality of measured values which were measured by other hearing aids, i.e. in particular by hearing aids of users, and/or from other sources. Sources other than the hearing aid of the user are also here advantageously used, and the quantity of data in the characteristic noise map thus significantly increased. In general, other sources are devices with a microphone, for example cash dispensers or traffic lights, and in particular smart phones and surveillance cameras. In general, the aim here is a most comprehensive possible collection of measured values of the situation parameter in order to obtain a most accurate possible characteristic noise map for a given location.

A hearing aid according to the invention can be operated by means of one of the above-described methods, and is preferably indeed operated with such a method. The hearing aid, in particular as already explained above, has a control unit which is designed such that a current noise situation is recognized both depending on the location and depending on time, and whichever program is assigned to the current noise situation is selected and set.

Other features which are considered as characteristic for the invention are set forth in the appended claims.

Although the invention is illustrated and described herein as embodied in a method for operating a hearing aid and a hearing aid, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
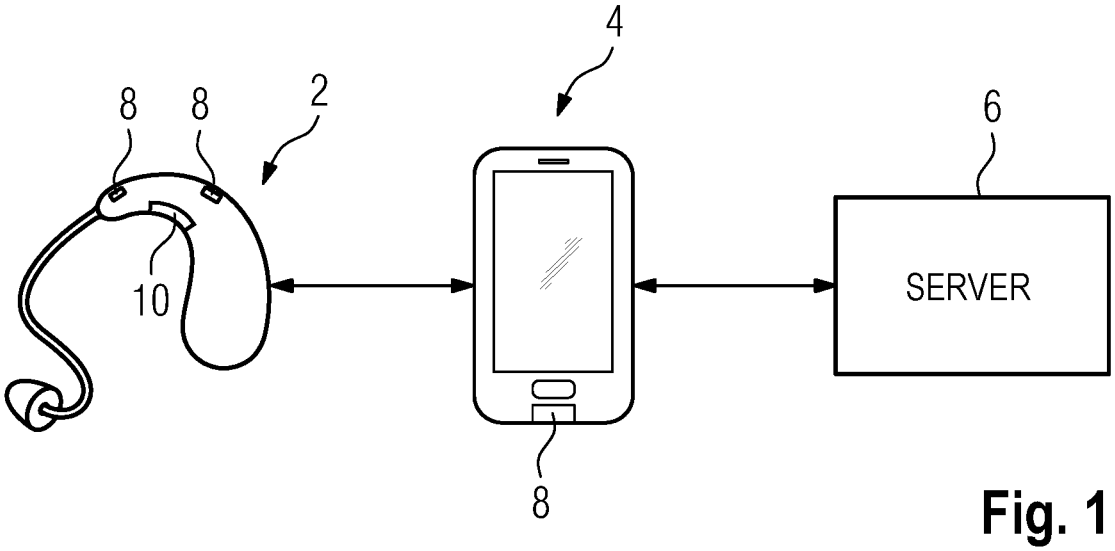
FIG. 1 is a schematic view of a hearing aid and external devices.

Referring now to the figures of the drawing in detail and first, particularly, to FIG. 1 thereof, there is shown a hearing aid 2 which is worn by a user (not illustrated). The hearing aid 2 is connected to external devices 4, 6 for data exchange, namely with a smart phone 4 and a server 6. The arrangement and the connection of the devices to one another shown here is merely an example. The hearing aid 2 and the smart phone 4 each have a microphone 8.

The hearing aid 2 also has a control unit 10, which automatically switches the hearing aid between different programs. A current noise situation is here first recognized, and then a suitable program is selected and set.

Figure 2:
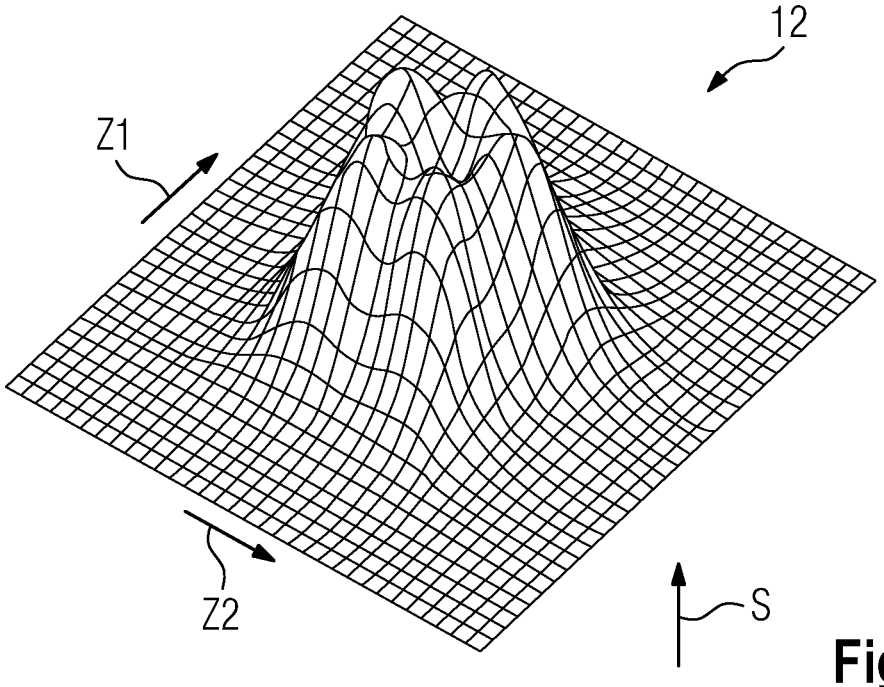
FIG. 2 is a schematic of a characteristic noise map for a particular location.

The noise situation is determined depending on time and location with reference to a characteristic noise map 12. An exemplary characteristic noise map 12 is shown in FIG. 2. The map 12 contains a situation parameter S for a particular location, in this case the volume level at this location, as a function of time Z1, Z2. The time Z1, Z2 is illustrated two-dimensionally in FIG. 2, namely as the time of day Z1 and as the day of the week Z2. How loud it is at the corresponding location at a time of day Z1 and a day of the week Z2 can thus also be determined from the characteristic noise map 12. The noise situation, namely for example whether loud or quiet, is thus also given in this way. A suitable program can then be selected and set in the light of this noise situation, in order to ensure optimum service to the user in the specific noise situation.

Figure 3:
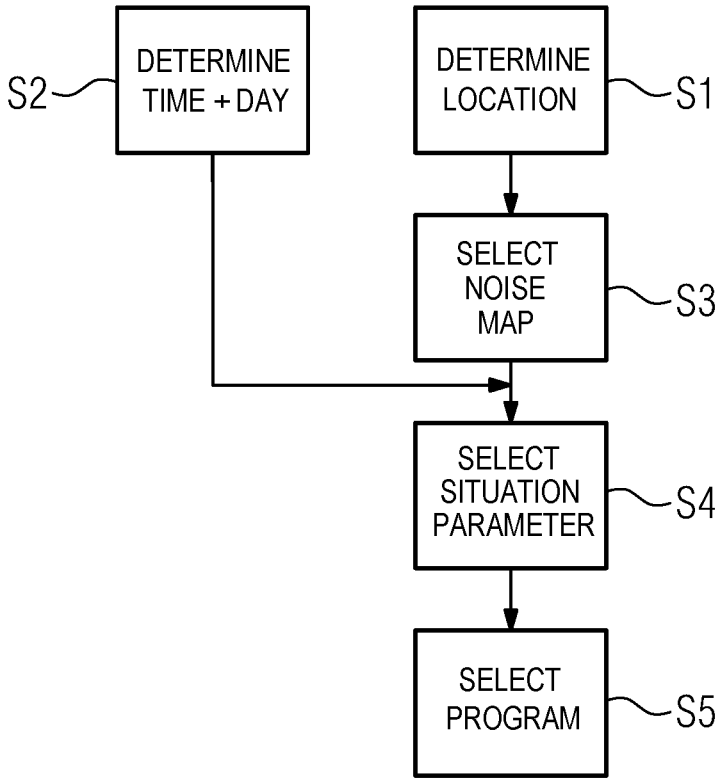
FIG. 3 is a flowchart illustrating a method for the operation of the hearing aid.

The flow of a method for operation of the hearing aid 2 is illustrated schematically in FIG. 3. A determination of the location S1 takes place first, wherein the location where the user is found is determined. Based on the location, i.e. depending on the location, a characteristic noise map 12, which is assigned to the location, and which contains its noise situation at different times Z1, Z2, is selected in a selection step S3. A time determination, S2, also takes place, wherein a determination is made of the current time Z1, Z2, e.g. as the time of day Z1 and the day of the week Z2. On the basis of the determined time Z1, Z2, the situation parameter S at the given time Z1, Z2 is determined from the characteristic noise map 12 in a recognition step S4, and the current noise situation is thereby recognized. On this basis, a suitable program is then selected and set in a setting step S5.

A respective characteristic noise map 12 is generated, in that the situation parameter S is measured repeatedly, is given a location stamp and a timestamp, and is stored. A characteristic noise map 12 is, for example, determined by the user, in that said user regularly determines the noise situation with his hearing aid 2, particularly using a noise analysis, and that this noise situation is then provided with a location stamp and a timestamp, and is saved. A plurality of such measurements are then combined into a characteristic noise map 12, and are then available for a later call-up. The characteristic noise map is, for example, stored on the hearing aid 2 and/or on an external device 4, 6.

Characteristic noise maps 12 for later use are generated in this way. In the example illustrated, the situation parameter S is the volume level. This is measured with a microphone 8 which is a microphone 8 of, for example, the hearing aid 2 or of the smart phone 4 or of another device. When the microphone 8 of the hearing aid 2 is used, the user continuously contributes to improvement of the characteristic noise map 12 at those locations that he or she regularly visits. The timestamp and the location stamp are each also here generated by the hearing aid 2 and/or by an external device 4, 6. When the microphone 8 of the smart phone 4 or, in general, another source for the measurement and for population of the characteristic noise map 12 is employed, sources other than the hearing aid 2 of the user are used, and the quantity of data in the characteristic noise map 12 is significantly increased. Alternatively or in addition to the smart phone 4, other sources are, for example, ATMs, traffic lights or surveillance cameras. In general, the aim here is a most comprehensive possible collection of measured values of the situation parameter S in order to obtain a most accurate possible characteristic noise map 12 for a given location.

The following is a summary list of reference numerals and the corresponding structure used in the above description of the invention:

2 Hearing aid
4 Smartphone
6 Server
8 Microphone
10 Control unit
12 Characteristic noise map
S Situation parameter
S1 Determination of location
S2 Determination of time
S3 Selection step
S4 Recognition step
S5 Setting set
Z1 Time of day
Z2 Day of week

The invention claimed is:

1. A method of operating a hearing aid to be worn by a user, the hearing aid having a plurality of programs respectively assigned to a noise situation, the method comprising:

recognizing a current noise situation depending on a current location and time;

selecting and setting whichever program is assigned to the current noise situation;

determining the current noise situation depending on the location and time by way of a characteristic noise map which contains the noise situation at a particular location as a function of time;

storing a situation parameter, depending on the location and time, in the characteristic noise map; and storing the situation parameter, two-dimensionally in terms of time as a function of a time of day and of a day of the week; and determining the noise situation by first determining the location and time, subsequently consulting the situation parameter in the characteristic noise map depending on the location and time, and subsequently determining the noise situation based on the situation parameter.

2. The method according to claim 1, which comprises recognizing the current noise situation depending on the location, and determining the location at which the user is currently found.

3. The method according to claim 2, which comprises determining the location at which the user is current found by way a GPS system.

4. The method according to claim 1, wherein a plurality of characteristic noise maps of a plurality of locations jointly form a characteristic map matrix.

5. The method according to claim 1, which comprises determining the noise situation depending on the location by carrying out a location classification in which a current location type is determined, and determining the noise situation, depending on time, in a characteristic noise map for the current location type.

6. The method according to claim 5, wherein a plurality of characteristic noise maps of a plurality of locations jointly form a characteristic map matrix.

7. The method according to claim 1, which comprises recognizing the current noise situation, depending on the location, by determining a location of the user in a two-dimensional space and, in addition, using an auxiliary magnitude by means of which different locations at the same site are distinguished.

8. The method according to claim 1, wherein a location is assigned to the characteristic noise map and the characteristic noise map is used for recognition of the noise situation if the user is at a particular location which is assigned to the characteristic noise map.

9. The method according to claim 1, which comprises providing the characteristic noise map by an external device that is external to the hearing aid.

10. The method according to claim 1, which comprises using an external device that is connected for data exchange to the hearing aid to determine the location, to determine the time, to recognize the current noise situation, or a combination of thereof.

11. The method according to claim 1, which comprises measuring a situation parameter with the hearing aid, generating a measured value, providing the measured value with a location stamp and a timestamp, and storing the measured value with the location stamp and the timestamp in a characteristic noise map.

12. The method according to claim 11, wherein the situation parameter measured with the hearing aid is a volume level.

13. The method according to claim 11, wherein the characteristic noise map is composed of a plurality of measured values which were measured by other hearing aids and/or by other sources.

14. A hearing aid to be operated by the method according to claim 1, the hearing aid comprising:

a plurality of programs respectively assigned to a given noise situation;

a control unit configured to recognize a current noise situation depending on a location and depending on time; and wherein the program that is assigned to the current noise situation is selected and set for operating the hearing aid.

15. A method of operating a hearing aid to be worn by a user, the hearing aid having a plurality of programs respectively assigned to a noise situation, the method comprising:

recognizing a current noise situation depending on a current location and time;

selecting and setting whichever program is assigned to the current noise situation;

determining the current noise situation depending on the location and time by way of a characteristic noise map which contains the noise situation at a particular location as a function of time;

measuring a situation parameter with the hearing aid, generating a measured value, providing the measured value with a location stamp and a timestamp, and storing the measured value with the location stamp and the timestamp in a characteristic noise map; and storing a volume level as a function of the time in the characteristic noise map as a situation parameter;

wherein the characteristic noise map is composed of a plurality of measured values that were measured by other hearing aids and/or by other sources.

16. A hearing aid to be operated by the method according to claim 15, the hearing aid comprising:

a plurality of programs respectively assigned to a given noise situation;

a control unit configured to recognize a current noise situation depending on a location and depending on time; and wherein the program that is assigned to the current noise situation is selected and set for operating the hearing aid.

* * * * *